US005647084A

United States Patent [19]

Still et al.

[11] Patent Number: 5,647,084

[45] Date of Patent: Jul. 15, 1997

[54] APPARATUS FOR CLEANING EXTERIOR OR HOSES, PIPES, ETC.

[76] Inventors: Ed Still, #3, 1023 Northmount Dr. NW., Calgary, AB T2L 0B6; David McRae, 145, 954-16 Ave. NE., Calgary, AB T2E 1L1, both of Canada

[21] Appl. No.: 588,575

[22] Filed: Jan. 18, 1996

[51] Int. Cl.[6] ..... B08B 9/02; B08B 1/00; B08B 3/00

[52] U.S. Cl. ..... 15/104.92; 15/40; 15/88; 15/88.1; 15/104.04; 15/160; 15/256.6

[58] Field of Search ..... 15/40, 77, 88, 15/88.1, 104.04, 104.92, 160, 205.2, 256.6

[56] References Cited

U.S. PATENT DOCUMENTS

| | | | |
|---|---|---|---|
| 663,282 | 12/1900 | Kress | 15/88 |
| 961,858 | 6/1910 | Hofmann | 15/40 |
| 3,189,935 | 6/1965 | Euga . | |
| 4,502,175 | 3/1985 | Hillis | 15/104.92 |
| 4,543,683 | 10/1985 | Goldman | 15/256.6 |
| 4,606,777 | 8/1986 | Brow | 134/38 |
| 4,734,950 | 4/1988 | Schenke et al. | 15/88 |
| 4,750,230 | 6/1988 | Osborn . | |
| 5,077,861 | 1/1992 | Bokat | 15/256.5 |
| 5,398,363 | 3/1995 | Medearis et al. | 15/104.92 |

FOREIGN PATENT DOCUMENTS

| | | | |
|---|---|---|---|
| 2254187 | 7/1975 | France | 15/40 |
| 887453 | 8/1953 | Germany | 15/40 |
| 366179 | 1/1963 | Switzerland | 15/40 |

*Primary Examiner*—Mark Spisich

*Attorney, Agent, or Firm*—Gene Scott - Patent Law & Venture Group

[57] ABSTRACT

A device having walls encloses a space. The walls provide an inlet aperture in opposition to an outlet aperture for admitting and withdrawing items, such as garden apparatus and tools, which are to be cleaned in the device. The interior space provides brushes set in opposition so that the exterior surface of an item drawn through the device is brushed clean. A structure for admitting water or other cleaning solution, and a structure for draining the solution are positioned in opposition on the walls of the enclosed space. Arms or rods are arranged so that the device may be mounted onto a wall or placed above the ground for easy access.

6 Claims, 2 Drawing Sheets

APPARATUS FOR CLEANING EXTERIOR OR HOSES, PIPES, ETC.

BACKGROUND OF THE INVENTION

1. Field of the Invention

This invention relates generally to cleaning machines and devices, and more particularly to an improved device suited for cleaning the outside surfaces of hoses, pipes, tools and the like.

2. Description of Related Art

Invention and use of cleaning devices for elongated articles is well known. For example, Euga, U.S. Pat. No. 3,189,935 teaches such a device having multiple compartments and using resilient pads such as sponges for rubbing against the sides of an article pulled through the device. It is clear that the drawback of such a device is that the sponges must be positioned and apertured in a custom fashion for each differently shaped article. Also, not having a freely flowing cleaning fluid, the device tends to become dirty first, at the point of contact with the article to be cleaned, and no mechanism is present to flush such dirt away. Brow, U.S. Pat. No. 4,606,777 teaches a paint roller cleaning device providing an annular water flushing means through which the roller is pushed and pulled. This has the advantage of flushing away the unwanted debris, in this case paint, to renew the devices' surface as the roller precedes through. Goldman, U.S. Pat. No. 4,543,683 teaches a rotating brush within a housing for cleaning items having a generally round surface. The surface must have a spiral pattern in order to drive the brush. Schenke et al, U.S. Pat. No. 4,734,950 teaches another round surface cleaning device. Finally, Bokat, U.S. Pat. No. 5,077,861 teaches a hose cleaning device providing brushes with bristles arranged in an annular fashion to wipe the surface of a hose as it passes through, and provides a continuous water flush as well. Clearly, the above devices, except for Euga, are for cleaning articles with a round cross-section such as a hose, a tube, a rod or a rope. It is clear also that only Bokat has combined the bristle brush with freely flowing cleaning liquid in a pressurized cabinet. However, the above devices cannot be used to clean objects having extensive shapes or objects which may be laid out over a finite surface area or are flat by nature such as metal, plastic and glass foils, sheets, and plates.

The present invention fulfills these needs and provides further related advantages as described in the following summary.

SUMMARY OF THE INVENTION

The present invention is an improved article cleaning device of the type discussed above in the description of related art. The device provides two sets of brushes arranged so that the brushes of one set of the brushes are in contact with the brushes of the other set when the device is cleaning an object or article to be cleaned. Walls of the device support the brushes and enclose the object to be cleaned so that water introduced into the device is contained and so that water pressure within the device may be built-up for improved scouring of the surfaces of the object. Drainage is provided for release of contaminated water and debris released by the cleaning action. An entry and an exit aperture or opening in the walls are provided so that a long object may be continuously pushed or pulled through the device while cleaning it. The motion of the object provides for scrubbing action of the brushes against its surfaces. Thus it is an object of the present invention to provide an improved cleaning device for cleaning objects such as hoses and ropes. It is another object of the present invention to provide a device for cleaning objects by flushing their surfaces with a liquid cleaning fluid while scrubbing the surfaces with bristle brushes, such scrubbing action being accomplished by moving the objects through the device by pushing or pulling. It is a further object of the present invention to provide a device as described with the capability of being mounted onto a surface or into a surface.

Other features, advantages and objects of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention, a device for cleaning objects. In such drawings.

DETAILED DESCRIPTION OF THE PREFERRED EMBODIMENT

Figure 1:
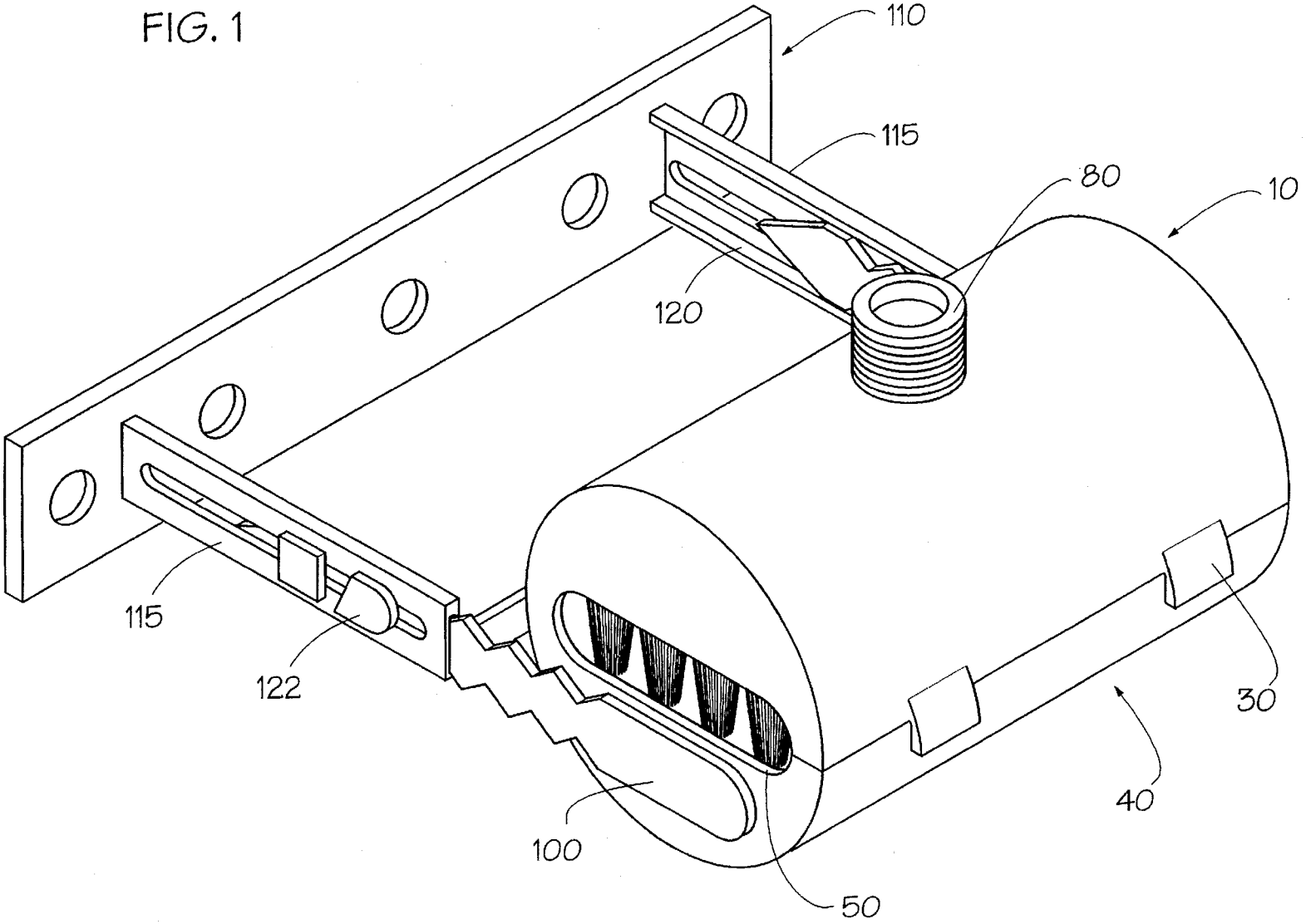
FIG. 1 is a perspective view of the preferred embodiment of the present invention, particularly showing how it might be mounted onto a wall.
Figure 2:
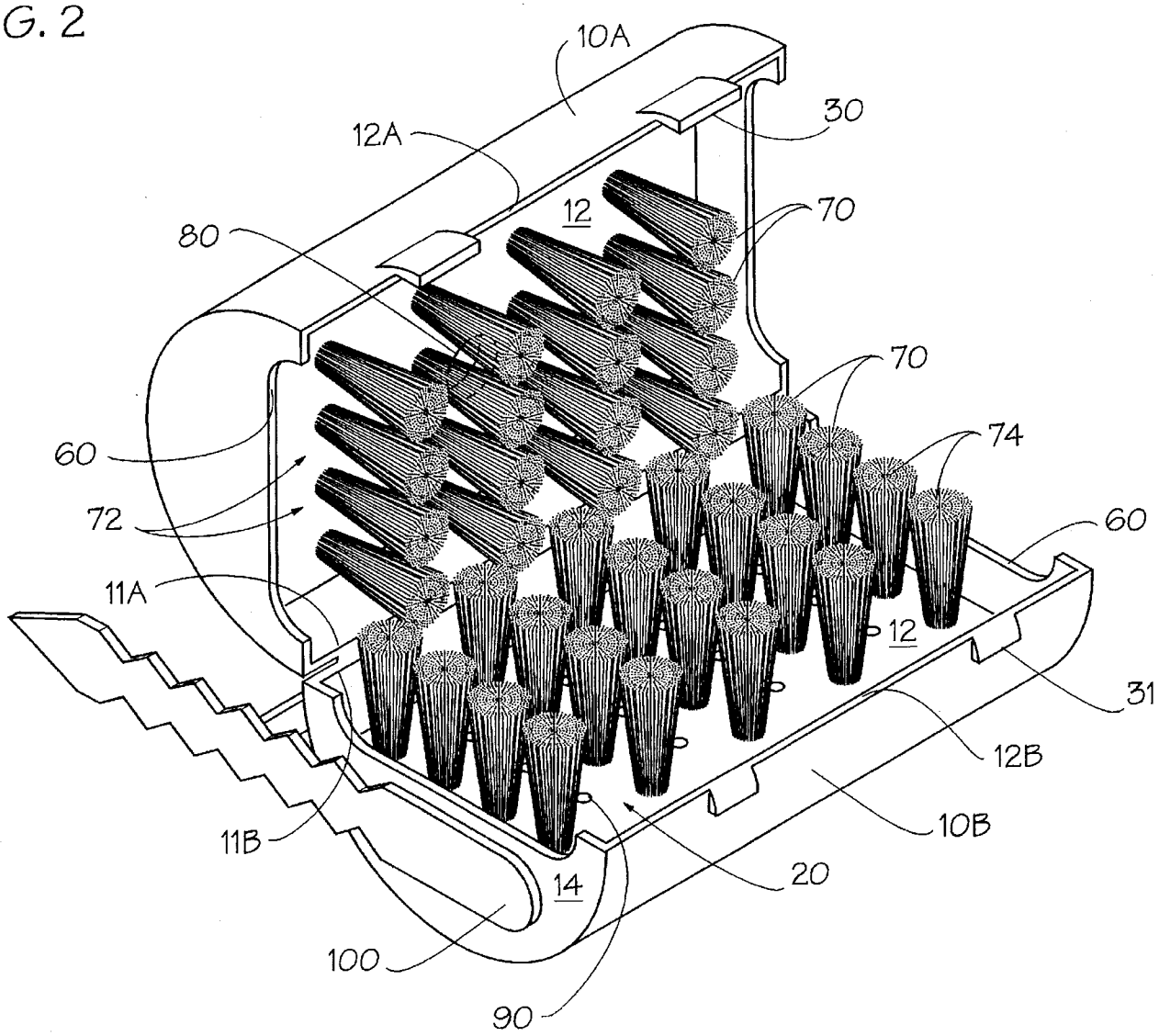
FIG. 2 is a perspective view thereof, particularly showing the interior of the device.

The above described drawing figures illustrate a device for cleaning objects such as hoses, ropes and other elongate articles. The device can also be used to clean metal, plastic and glass sheets and other flat or irregular shaped objects and articles. The device provides separable, and alternately joinable housing walls 10, preferably two walls 10A and 10B, enclosing a space 20 between them. The walls 10 are preferably hinged along one edge 11A and 11B of each so as to allow the walls 10 to pivot in separation. The preferred hinge is formed integrally with the walls 10 by a molding process forming a living hinge. Preferably the walls 10 also provide a means for latching, such as a molded latching clasp 30 and corresponding latching boss 31 as shown in FIGS. 1 and 2, on the opposing edges 12A and 12B respectively, for retention of the walls 10 in a closed position 40 (FIG. 1). The walls 10 could alternately be latched along both edges 11A, 11B and 12A, 12B so that they are fully separable, but still able to be connected together for enclosing the space 20. The walls 10 provide opposing apertures 60 for an article to be introduced into the space 20 and to be, afterward, withdrawn from the space 20. The apertures 60 are preferably elongated openings in opposed positions in the walls 10 and thus define a direction of article movement within the device between them. Since the device is symmetrical with respect to the apertures 60, articles may move through the device in either direction. Within the walls 10, sets of brushes 70 are fixed to, and extend from a pair of interior surfaces 12 respectively. With the walls 10 in the closed position 40, the interior surfaces 12 are positioned in a spaced apart and mutually parallel orientation so that the sets of brushes 70 are laying in alternate staggered positions, i.e., the sets of brushes 70 are generally oriented in opposing directions and orthogonal to the direction of article movement as defined above. Furthermore the sets of brushes 70 are staggered so that spaces 72 between individual brushes of each of the sets of brushes 70 are positions of the individual brushes of the other of the sets of brushes 70. A means for introducing water 80 into the space 20 is provided, preferably one or more hose fittings mounted through one of the walls 10, and a means for draining 90 water from the space 20 is provided, preferably in the opposing wall or walls 10 so that water travels across the space 20 from water source 80 to water drain 90. The draining means 90 is preferably a plurality of drain holes.

One or more mounting rods 100 may be used with the device. These rods 100 preferably are attached to the exterior surface 14 of one of the walls 10 and are arranged in a common direction. Preferably, two rods 100 are arranged at opposite ends of the housing wall. Further, a mounting bracket 110 is provided with a means for engaging 120 the rods. This engaging means 120 is preferably a pair of linear arms 115 having means for rod engagement adjustment 122. In this manner the device may be mounted onto a wall or other structure. Alternately, the rods 100 may be inserted into the ground so that the device is held in a convenient position above the ground.

In use, a hose or other source of water having appropriate water pressure is attached to the means for introducing water 80 and water flow is started. The article to be cleaned, such as a hose, a rope, a garden tool, or other object is then pushed into the inlet 50 in the wails. The article is withdrawn from the outlet 60, the article thereby moving continuously into the inlet 50 in the walls until the entire article has been drawn through the device. Since, preferably, the ends of the brushes 74 do not allow for any clearance for the article, the bristles are bent over during cleaning by the articles' presence and are therefore forcefully pressed against the sides of the article so as to cause a scrubbing action on them. Soap or other cleaning agents may be introduced into the device with the water flow, or may be placed within the housing before starting cleaning operations. Preferably, drainage from the device assures that the article to be cleaned is constantly being flushed with water or other cleaning agent while scrubbing action is assured by the tight fit of the object against the brushes. For articles such as ropes and hoses which cannot be pushed into the device, the article is pulled from the device as it is cleaned.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A cleaning device consisting of:

a pair of integrally molded, opposing, hingably-joined, housing walls enclosing a space therein, the walls including a pair of opposing apertures for introducing an article into the space and for extracting the article from the space;

and integrally molded with the housing walls, a pair of interior planar surfaces, each of the surfaces providing a set of commonly aligned brushes extending therefrom to a common height, and integrally molded with the housing walls, a means for retention of the opposed walls when said walls are placed in a closed position, thereby positioning the pair of interior surfaces in a spaced apart and mutually parallel orientation, the sets of brushes laying in alternate staggered positions;

and a means for introducing water into the space; and means for draining water from the space, said draining means being generally positioned below the introducing means.

2. The device of claim 1 further including at least one mounting rod fixed exteriorly to one of the pair of housing walls and extending therefrom, the at least one rod providing a pointed distal end whereby the at least one rod may be easily driven into the ground for supporting the device above the ground.

3. The device of claim 2 wherein the at least one rod comprises two rods in parallel fixed positions.

4. The device of claim 3 further including a mounting bracket having means for engaging the rods.

5. The device of claim 4 wherein the engaging means includes a pair of linear arms having means for length adjustment.

6. The device of claim 1 wherein the water introducing means is at least one fitting on one of the housing walls and the water draining means is a plurality of holes in one of the interior surfaces, the holes positioned in opposition to the at least one fitting.

* * * * *